US005774917A

United States Patent [19]

Liu

[11] Patent Number: 5,774,917

[45] Date of Patent: Jul. 7, 1998

[54] TURN MATTRESS INHERENTLY FORMED WITH SIDE GUARDS

[76] Inventor: Antony Ching-fong Liu, P.O. Box 55-846, Taipei, Taiwan

[21] Appl. No.: 879,799

[22] Filed: Jun. 20, 1997

[51] Int. Cl.[6] ..... A61G 7/057

[52] U.S. Cl. ..... 5/715; 5/710; 5/609

[58] Field of Search ..... 5/609, 710, 713, 5/715, 739

[56] References Cited

U.S. PATENT DOCUMENTS

| | | | |
|---|---|---|---|
| 4,947,500 | 8/1990 | Seiler | 5/713 |
| 4,949,414 | 8/1990 | Thomas et al. | 5/715 X |
| 5,092,007 | 3/1992 | Hasty | 5/715 |
| 5,251,349 | 10/1993 | Thomas et al. | 5/715 X |
| 5,375,273 | 12/1994 | Bodine, Jr. et al. | 5/715 X |
| 5,394,577 | 3/1995 | James et al. | 5/715 X |
| 5,619,764 | 4/1997 | Kopau | 5/715 X |

*Primary Examiner*—Michael F. Trettel

[57] ABSTRACT

A turn mattress includes a plurality of inflatable sacs juxtapositionally connected together within a mattress envelope, each inflatable sac being transverse to a longitudinal axis of the mattress and having a right cell and a left cell separated by a central diaphragm and respectively communicated with an air distributing system to be alternatively inflated or deflated for turning a patient ridden on the mattress from side to side, and a pair of restoring air bags each inherently formed and constantly inflated in each cell, whereby upon deflation of either cell, the restoring air bag as inflated will serve as a side guard for preventing a slipping of the patient away from the mattress laid on a hospital bed.

7 Claims, 5 Drawing Sheets

TURN MATTRESS INHERENTLY FORMED WITH SIDE GUARDS

BACKGROUND OF THE INVENTION:

James et al. disclosed a therapeutic anti-decubitus lateral rotation mattress in their U.S. Pat. No. 5,394,577 including a plurality of pairs of inflatable air cells disposed on opposite sides of a longitudinal axis and arranged along the length of a bed so that the cells on alternate sides are inflated while simultaneously the cells on the other side are deflated to turn the bed-ridden patient periodically to relieve his/her stress on the body for the relief of pressure sores and the rehabilitation of tissues of the bed-ridden patient.

However, when turning the patient's body on the mattress either rightwardly or leftwardly, the patient may be accidentally slipped away from the bed to cause serious injury to the patient if the side rails are not raised on the hospital bed.

The present inventor has found the drawback of the conventional turn mattress, and invented the present turn mattress having side guards provided in the mattrees.

SUMMARY OF THE INVENTION:

The object of the present invention is to provide a turn mattress including a plurality of inflatable sacs juxtapositionally connected together within a mattress envelope, each inflatable sac being transverse to a longitudinal axis of the mattress and having a right cell and a left cell individually separated by a central diaphragm and respectively communicated with an air distributing system to be alternatively inflated or deflated for turning a patient ridden on the mattress from side to side, and a pair of restoring air bags each inherently formed and constantly inflated in each cell, whereby upon deflation of either cell, the restoring air bag as inflated will serve as a side guard for preventing a slipping of the patient away from the mattress laid on a hospital bed.

Figure 1:
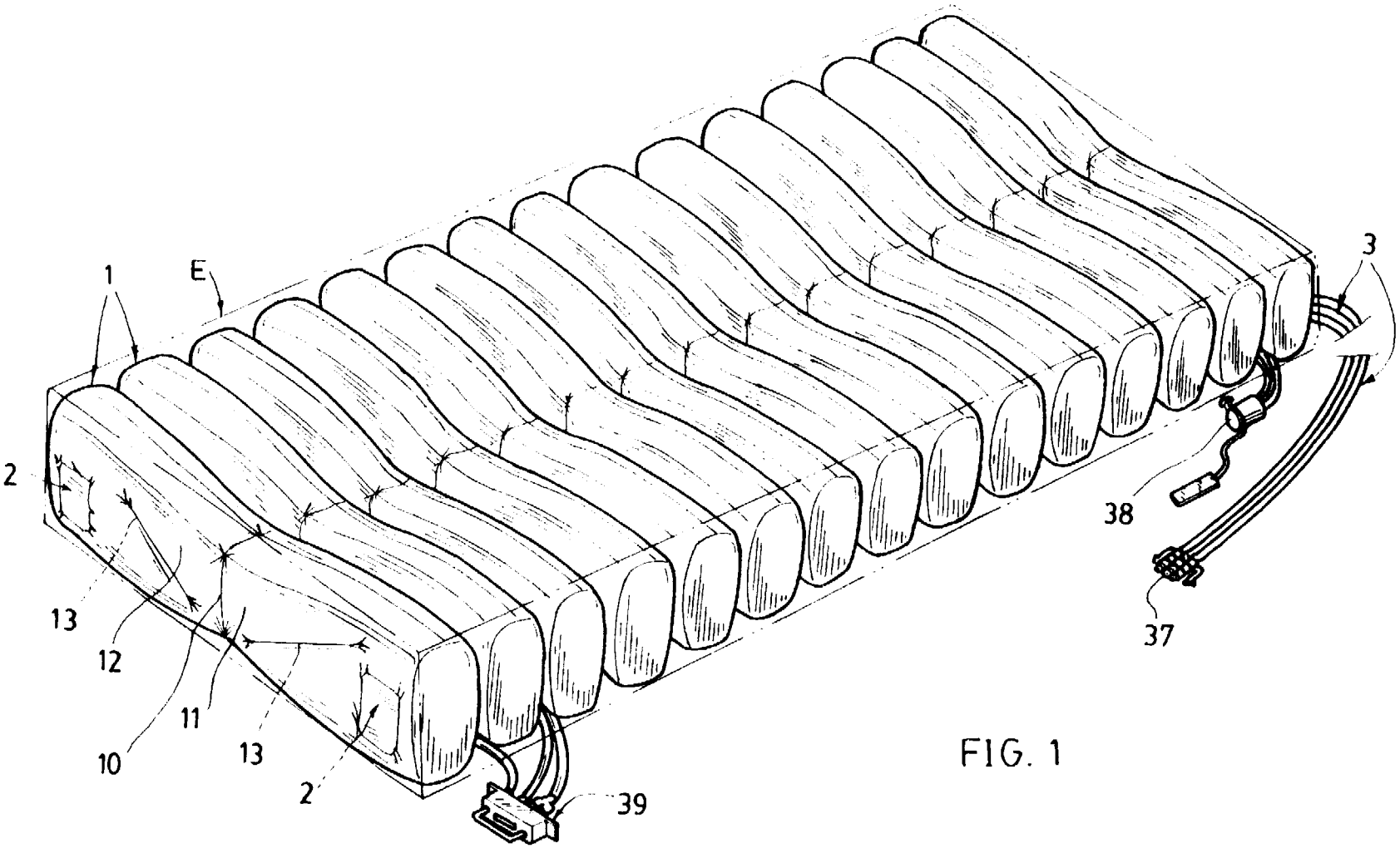
FIG. 1 is a perspective view of the present invention.

DETAILED DESCRIPTION:

As shown in the drawing figures, a turn mattress defining a longitudinal axis X along a length of the mattress in accordance with the present invention comprises: a plurality of inflatable sacs 1 juxtapositionally connected together within a mattress envelope E, each sac 1 having a pair of restoring air bags 2 respectively internally formed in opposite sides of the sac 1, and an air distributing means 3 fluidically communicated with the sacs 1 and the air bags 2.

Figure 2:
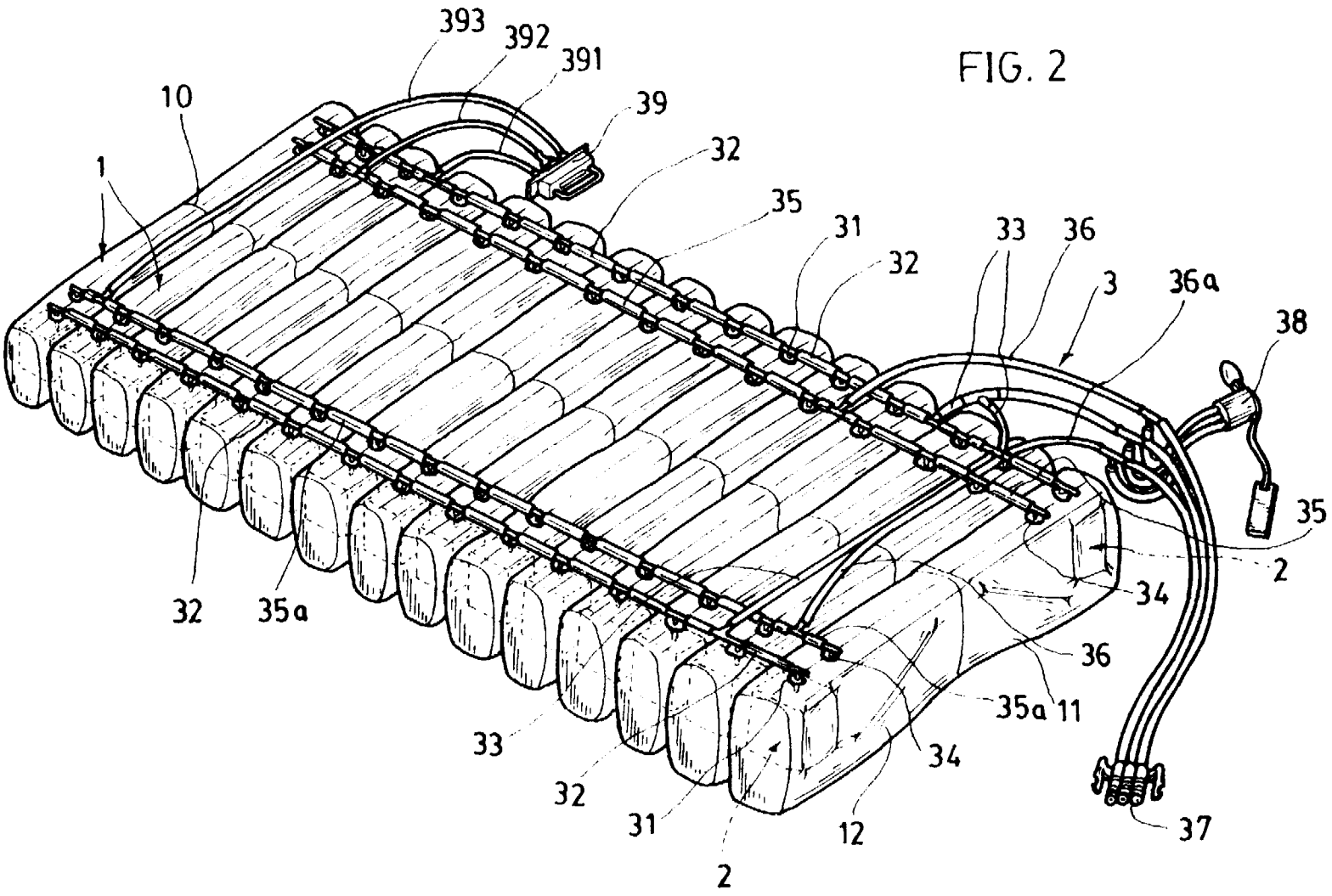
FIG. 2 is a bottom-view illustration of the present invention when inverted from FIG. 1.

The number and shapes of the sacs 1 are not limited in the present invention. Each sac 1 may have a cross section of rectangular, oblong or oval shape, but not limited. The air distributing means 3 may be preferably provided at a bottom of the mattress as shown in FIG. 2. Each restoring air bag 2 may have a cross section of rectangular shape.

Each inflatable sac 1 includes: a right cell 11, and a left cell 12 individually separated from the right cell 11 with a central diaphragm 10, each cell 11 or 12 having a retaining membrane 13 circumferentially secured to an inside wall of each cell 11 or 12 to prevent unexpected bulging of the cell 11 or 12 when inflated. The retaining membrane 13 may be formed as a rectangular shape to limit the inflated cell 11 or 12 to have a cross section of rectangular or oval shape.

For ventilation purpose during inflation or deflation of each cell 11, 12, the retaining membrane 13 should have a bottom aperture 131 and an upper aperture 132 to be spaced from the bottom and top inside walls of the cell 11, 12.

Each restoring air bag 2 is inherently formed in and integrally formed with each cell 11 or 12. Each air bag 2 is constantly inflated and positioned adjacent to an utmost side portion of each cell 11 or 12 to be distally opposite to the central diaphragm 10. Each air bag 2 is preferably formed as a rectangular shape from a cross section of the bag 2 when viewed from a cross section transverse to the longitudinal axis X of the mattress of this invention.

Figure 5:
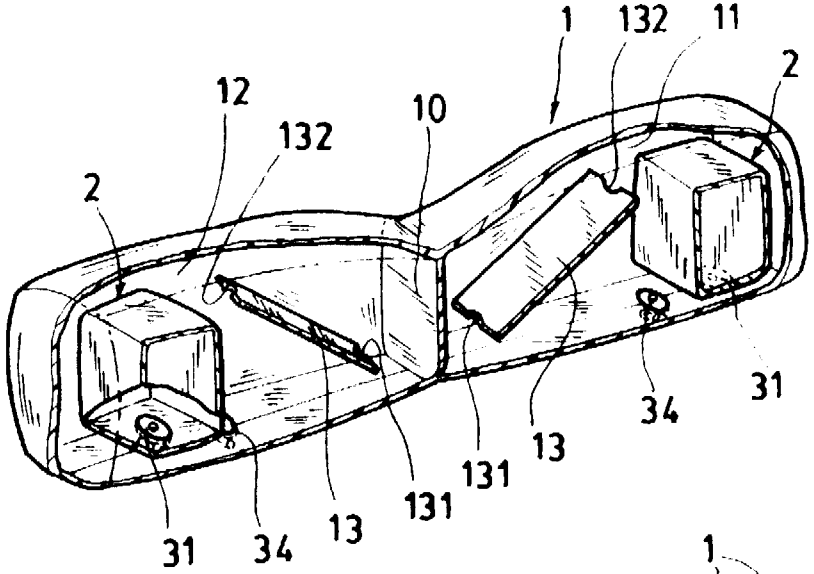
FIG. 5 is a partial cut-away illustration of each inflatable sac of the present invention.

The air distributing means 3 includes: at least a bag hose 33 or a pair of bag hoses 33, 33 respectively connected to a pair of inflating header tubes 32, 32 each inflating header tube 32 perpendicular to each cell 11, 12 and having a plurality of inflating adapters 31 juxtaposionally connected to the inflating header tube 32 to communicate with each restoring air bag 2; two sac hoses 36, 36*a* respectively connected to two inflating and deflating header tubes 35, 35*a* each header tube 35, 35*a* perpendicular to each cell 11, 12 and having a plurality of inflating and deflating adapters 34 juxtapositionally connected to the inflating and deflating header tube 35, or 35*a* to communicate with each cell 11 or 12 (FIG. 5); a plurality of couplings 37 connected with a plurality of terminals of the bag hoses 33 and sac hoses 35, 35*a* for connecting an utility air supply such as pre-designed in a hospital through a pump control unit (not shown); a quick-filled pump 38 connected through bypass conduits to the bag hoses 33 and sac hoses 35, 35*a* to auxiliarily supply air into the cells 11, 12 and air bags 2 or sucking air therefrom; and an emergency releasing coupling 39 respectively connected to the air bags 2 and the cells 11, 12 through at least a bag deflating hose 391 and two cell deflating hoses 392, 393 as shown in FIG. 2 for instantly releasing air outwardly to descend the patient B ridden on the mattress for cardiopulmonary resuscitation (CPR) use. Other piping or tubing systems may be otherwise modified in accordance with the present invention.

Figures 3, 4:
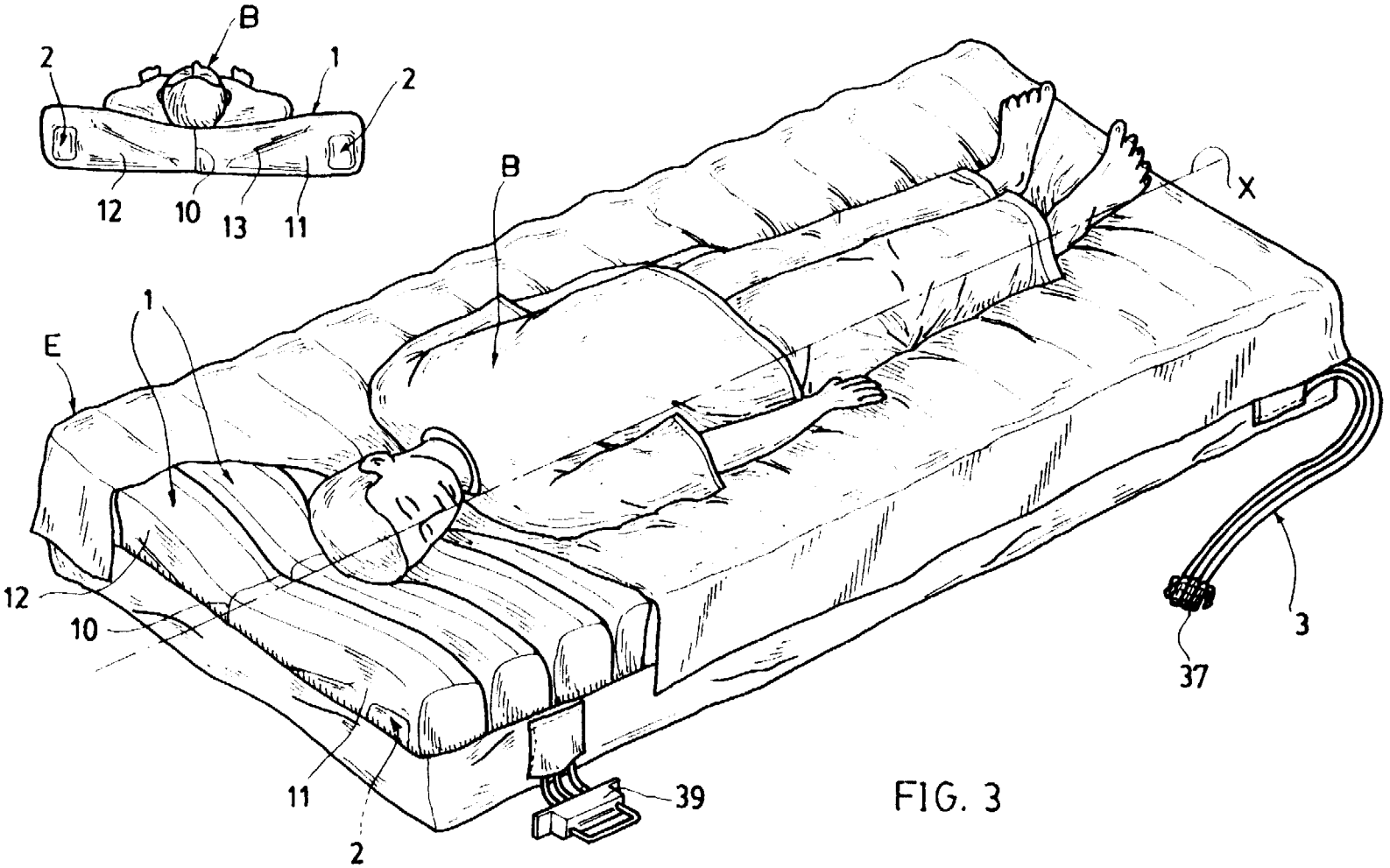
FIG. 3 is an illustration showing a patient horizontally ridden on the mattress of the present invention.
FIG. 4 is a left side view of FIG. 3.

As shown in FIGS. 3, 4, a patient's body B is normally laid on the mattress of the present invention as horizontally positioned when both right and left cells 11, 12 are simultaneously inflated.

Figure 6:
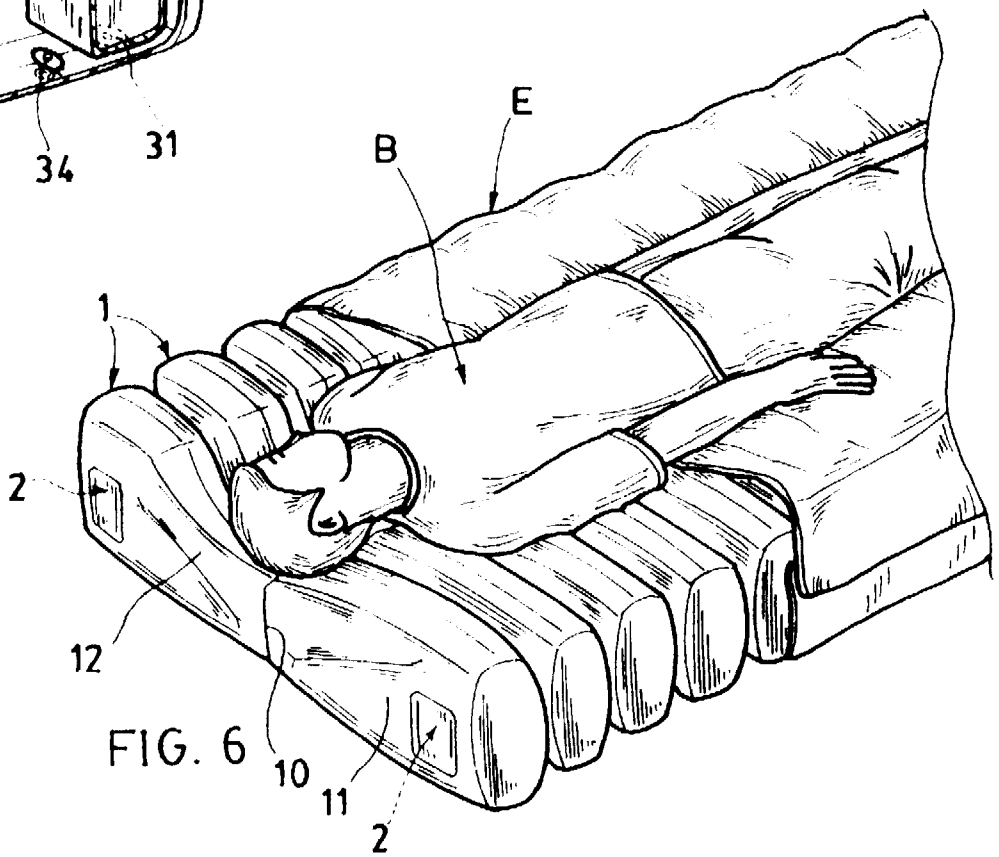
FIG. 6 is an illustration of the present invention showing a left-turn patient ridden on the mattress.
Figure 8:
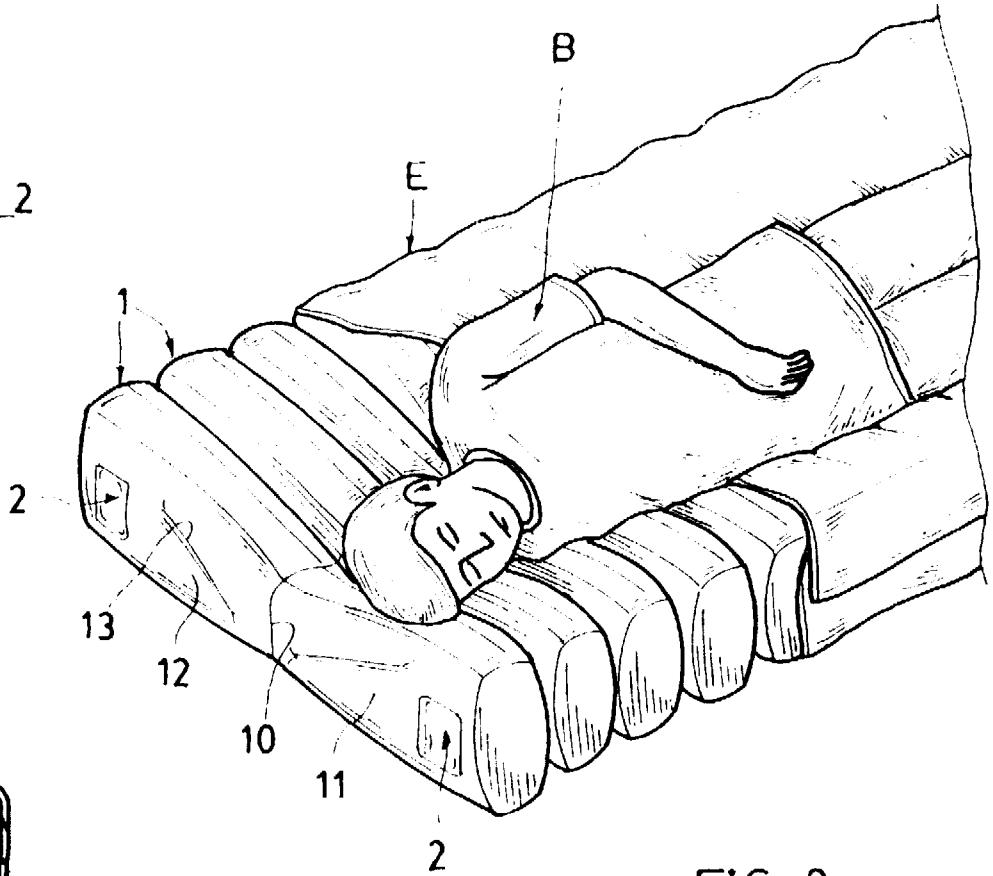
FIG. 8 is an illustration of a right-turn patient ridden on the mattress.
Figure 7:
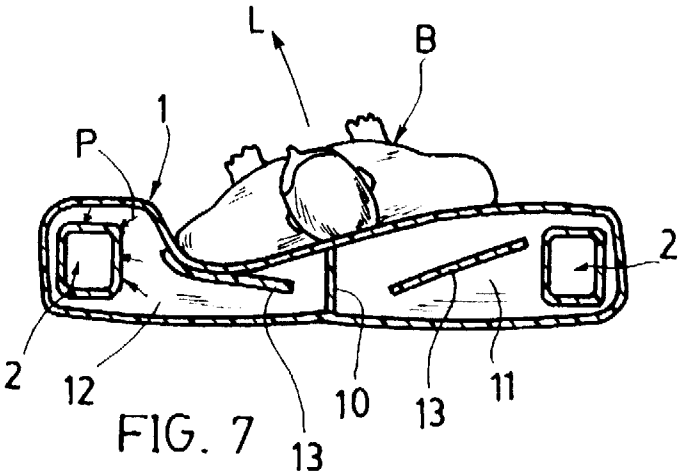
FIG. 7 is a left-side view of FIG. 6.
Figure 9:
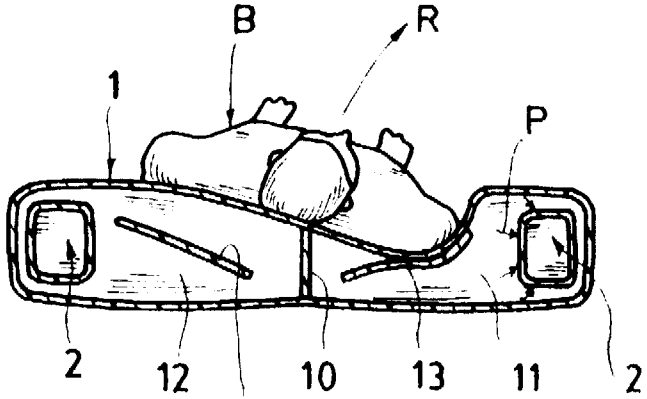
FIG. 9 is a left-side view of FIG. 9.

By alternatively inflating and deflating the right cells 11 and the left cells 12 of the sacs 1, the patient can be turned from side to side for preventing pressure sores. For instance, when inflating the right cells 11 through the sac hose 36, the left cells 22 are deflated through the sac hose 36*a*. As shown in FIGS. 6, 7, the patient B is turned leftwardly (L) by inflating the right cell 11 and deflating the left cell 12 to pressurize the restoring air bag 2 located in the left cell 12 to compress the air inflated in the air bag 2 as indicated by arrows (P) to store the potential energy of the compressed air in the bag to help restore the patient's body from left side to right side when subsequently inflating the left cell 12 while deflating the right cell 11 as shown in FIGS. 9, 8 to turn the patient's body B rightwardly (R) from the position as shown in FIGS. 7, 6. During the turning operations either leftwardly (L) or rightwardly (R), the restoring air bags 2 are constantly inflated by filling air into the bags 2 through the bag hoses 33, the header tubes 32 and the plural adapters 31. So, the bags 2 constantly inflated will serve as a side guard or "side rail" to prevent from slipping of patient away from the mattress for safely protecting the patient especially as shown in FIGS. 7, 9.

Accordingly, each restoring air bag 2 in each cell 11 or 12 plays double roles, namely, serving as a side guard for safely protecting the patient from slipping or falling from the mattress; and helping restoring of turning operations from side to side, thereby being superior to the prior art of U.S. Pat. No. 5,394,577 to James et al.

The present invention may be modified without diparting from the spirit and scope of this invention. The sacs 1 may be secured to the envelope E, or may be integrally fixed on a flexible substrate sheet (not shown) which is then encased in a mattress cover by any conventional methods, not limited in this invention.

I claim:

1. A turn mattress having a longitudinal axis along a length of the mattress comprising:

a plurality of inflatable sacs juxtapositionally connected together in a mattress envelope, each said inflatable sac being transverse to said longitudinal axis of said mattress, and each said inflatable sac including a right cell and a left cell individually separated from said right cell with a central diaphragm;

a plurality of pairs of restoring air bags respectively inherently formed in said right and left cells of said inflatable sacs, each said restoring air bag positioned in each said cell adjacent to an utmost side portion of each said cell to be distally opposite to each said central diaphragm in each said sac, each said restoring air bag constantly inflated to serve as a side guard when said cell is deflated; and an air distributing means fluidically communicated with said restoring air bags and with said right and left cells for inflating the bags and inflating or deflating the cells, whereby upon alternative inflation and deflation of said right and left cells, a patient laid on said sacs will be turned from side to side; and upon constant inflation of said restoring air bags in said cells, said air bags as inflated in a right or a left side of said mattress will prevent slipping of the patient away from the mattress.

2. A turn mattress according to claim 1, wherein each said cell of said inflatable sac includes a retaining membrane circumferentially secured in an inside wall of each said cell to prevent bulging of each said cell when inflated.

3. A turn mattress according to claim 2, wherein said retaining membrane has a bottom aperture and an upper aperture respectively spaced from a bottom and a top inside wall of said cell for ventilation when said cell is inflated or deflated.

4. A turn mattress according to claim 1, wherein each said restoring air bag is integrally formed in each said cell adjacent to an utmost side portion of each said cell distal from said central diaphragm.

5. A turn mattress according to claim 1, wherein each said restoring air bag has a rectangular-shaped cross section, as transverse to said longitudinal axis of said mattress.

6. A turn mattress according to claim 1, wherein said air distributing means includes: a pair of bag hoses connected to a pair of inflating header tubes each said inflating header tube perpendicular to each said cell and having a plurality of inflating adapters juxtaposionally connected to the inflating header tube to communicate with each said restoring air bag; two sac hoses respectively connected to two inflating and deflating header tubes each said inflating and deflating header tube perpendicular to each said cell and having a plurality of inflating and deflating adapters juxtapositionally connected to each said inflating and deflating header tube to communicate with each said cell; and said bag hoses and said sac hoses connectable to an air supply system through a pump control unit for inflating said bag hoses and said sac hoses.

7. A turn mattress according to claim 6, wherein said air distributing means further includes a quick-filled pump connected through by-pass conduits to the bag hoses and sac hoses to auxiliarily supply air into the cells and air bags.

* * * * *